US009206025B2

(12) United States Patent
Sierra et al.

(10) Patent No.: US 9,206,025 B2
(45) Date of Patent: Dec. 8, 2015

(54) MULTIPLE DRUM HANDLING APPARATUS

(71) Applicant: Delta Petroleum Company, Inc., Delaware, OH (US)

(72) Inventors: Fredy Sierra, Houston, TX (US); Juan Francisco Leija, Houston, TX (US); Miguel Angel Salazar, South Houston, TX (US); Armando Ernesto Martinez, Houston, TX (US); Phung Minh Nguyen, Seabrook, TX (US); Mariano Paulin, Houston, TX (US); Marlo Gomez, Pasadena, TX (US); Jesus Garcia, Cypress, TX (US); David K. Washburn, Alvin, TX (US); Jackie S. Mote, Kingwood, TX (US)

(73) Assignee: Delta Petroleum Company, Inc., Delaware, OH (US)

( * ) Notice: Subject to any disclaimer, the term of this patent is extended or adjusted under 35 U.S.C. 154(b) by 6 days.

(21) Appl. No.: 13/969,642

(22) Filed: Aug. 19, 2013

(65) Prior Publication Data

US 2014/0049062 A1 Feb. 20, 2014

Related U.S. Application Data

(60) Provisional application No. 61/684,710, filed on Aug. 18, 2012.

(51) Int. Cl.
*B66F 9/06* (2006.01)
*B66F 9/18* (2006.01)

(52) U.S. Cl.
CPC ..... *B66F 9/187* (2013.01)

(58) Field of Classification Search
USPC ..... 294/119.1, 87.1, 81.6, 81.61, 81.62, 90, 294/103.1, 113, 162; 414/607, 618, 621, 414/623, 626
See application file for complete search history.

(56) References Cited

U.S. PATENT DOCUMENTS

| | | | | |
|---|---|---|---|---|
| 2,548,063 | A | 4/1951 | Reinhart | |
| 2,548,064 | A | 4/1951 | Reinhart | |
| 2,614,711 | A | 10/1952 | Houser | |
| 2,661,879 | A | 12/1953 | Lee et al. | |
| 2,702,641 | A * | 2/1955 | Arthur | 294/87.1 |
| 2,807,493 | A | 9/1957 | Ryan et al. | |
| 2,924,484 | A | 2/1960 | Tolsma | |
| 3,158,275 | A | 11/1964 | Hart | |

(Continued)

FOREIGN PATENT DOCUMENTS

DE 4306887 3/1994

OTHER PUBLICATIONS

English Abstract from Espacenet of DE 4306887, 1 page.

*Primary Examiner* — Paul T Chin
(74) *Attorney, Agent, or Firm* — Mark E. Bandy; Rankin, Hill & Clark LLP

(57) ABSTRACT

An apparatus is disclosed that serves as an attachment for a forklift truck or the like for handling multiple drums simultaneously. The drums to be transported are arranged symmetrically in a cluster about a central vertical axis. The apparatus includes a slidable suspension plate that connects to a latching device adapted to clamp onto the rim of each drum in the cluster. The sliding movement of the suspension plate is confined to a linear path of travel by guide rails. The limited forward/rearward linear movement aids in locating the clamping device accurately relative to the central vertical axis of the cluster.

18 Claims, 4 Drawing Sheets

(56) References Cited

U.S. PATENT DOCUMENTS 3,194,422 A * 7/1965 Shinn, Jr. ..... 294/87.1
3,338,616 A 8/1967 Ericson
3,718,228 A 2/1973 Lund et al.
4,911,605 A 3/1990 Berg

* cited by examiner

MULTIPLE DRUM HANDLING APPARATUS

PRIORITY CLAIM

The present application claims benefit from U.S. Provisional Patent Application Ser. No. 61/684,710 filed Aug. 18, 2012 which is incorporated herein by reference.

BACKGROUND OF THE INVENTION

1. Field of the Invention

This invention relates to mobile transport equipment for handling drums and especially to apparatus adapted for use in association with fork lift trucks and the like for lifting and transporting multiple drums simultaneously.

2. Description of the Related Art

Various types of mobile carriers for handling multiple drums are known in the art and it is common practice to handle such drums while arranged in a symmetrical cluster. A clamping device is used to engage and latch onto the rim of each drum in the cluster and then the drums are lifted simultaneously and transported to a new location. This is generally accomplished with an apparatus adapted for use as an attachment for a forklift truck or the like.

Typical prior art apparatus of this type is described in Erickson U.S. Pat. No. 3,338,616, Lund and Erickson U.S. Pat. No. 3,718,228, and Berg U.S. Pat. No. 4,911,105.

U.S. Pat. No. 3,338,616 discloses a drum handling apparatus designed to handle four drums simultaneously. The drums are arranged in a symmetrical cluster about a central axis so that the cluster defines a four-pointed-star-shaped central space.

The apparatus includes a clamping device that carries four sets of jaws, each set being adapted to clamp onto the rim of one of the drums. The clamping device is positioned by a forklift truck or the like over the central space and then lowered into the space to a clamping position. The lowering and lifting movement of the device is effective to operate the jaws sequentially as needed throughout the drum handling cycle.

The clamping device is suspended below a horizontal mounting plate by means of four suspension bolts that extend downwardly through respective holes formed in the plate. The holes are considerably larger in diameter than the bolts and each bolt forms part of a bolt assembly that includes a relatively large diameter washer. The washers are located below the respective bolt heads and bear against the top surface of the mounting plate in the surface portions that surround the holes. Accordingly, the washers are able to slide against the top surface of the mounting plate to enable the suspension bolts (as well as the clamping device) to move horizontally in any direction within the limits defined by the edges of the bolt holes.

When sliding movement occurs, it is generally caused by engagement between the clamping device and the drums as the clamping device is lowered into the central space defined by the sides of the drums. This engagement urges the clamping device into approximate vertical alignment with the central axis of the four-drum cluster.

U.S. Pat. No. 3,718,228 discloses a drum handling apparatus similar to that of U.S. Pat. No. 3,338,616, but wherein the clamping device has a much longer vertical dimension. The apparatus has the capability of handling, during each lifting and transporting cycle, from one to four drums, as the situation requires. This capability is achieved by engaging and restraining each drum during the handling process in such a way as to prevent tipping. Without this feature an attempt to handle less than four drums would result in excessive tipping when the drum or drums are lifted.

More particularly, the clamping device is provided with relatively long vertical guide members that engage the sides of the drum or drums as low as the middle cylindrical panel (or central panel) as defined by the annular drum rings. These guide members are effective to prevent any excessive inward tipping of the bottom of the drum or drums as they are lifted regardless of the number of drums being handled (assuming four or less).

U.S. Pat. No. 4,911,605 discloses a multiple drum handling apparatus similar to that of U.S. Pat. No. 3,718,288, except that the clamping device has modified clamping jaws to better accommodate "L" shaped peripheral chime rings currently used on molded plastic drums.

Each of the prior art assemblies described above has a frame adapted to be carried by a forklift truck or the like. The forks of the lift truck are inserted in shoes (horizontal parallel tubular members) that form part of the frame.

The frame also has a pair of laterally spaced vertical legs located at the rearward end thereof adjacent the masts of the lift truck. The legs extend downwardly and (in the case of a four-drum cluster) provide back rests adapted to engage two of the drums of the cluster.

In the operation of the various multiple drum handling assemblies shown in the above patents, the apparatus is first carried by a forklift truck or the like to a preliminary position adjacent to the drum cluster. At this point, the latching device is urged to a centered position relative to the mounting plate by centering springs. In the case of a four-drum cluster, the operator of the lift truck moves the handling apparatus toward one side of the cluster until the back rests engage two of the drums. In this position, the latching device carried by the frame should be located over the central space and in approximate forward/rearward linear alignment with the central vertical axis of the drum cluster.

Also, the lift truck operator, by visual reference, locates the lift truck so as to position the clamping device in lateral (left/right) alignment with the central vertical axis of the cluster. This lateral positioning may be accomplished more accurately by the operator than the forward/rearward alignment due to his clearer view of the left/right position of the latching device.

Then, as the latching device is lowered into the central space, vertical guides associated with the latching device may engage portions of the drums as necessary to urge the latching device into more accurate vertical alignment with the central vertical axis of the drum cluster. This resulting movement, which may be in any horizontal direction, is enabled through the sliding movement of the suspension bolt assembly washers or the suspension plate, on the mounting plate.

One problem associated with drum handling apparatus of the type described is that the initial lateral location of the latching device relative to the frame could be at its left or right limit position rather than on the forward/rearward centerline of the frame. This could occur, for example, if the suspension bolt assemblies or suspension plate had slid sideways prior to initiation of the handling process.

If the fork-lift truck operator set the initial lateral position of the clamping device relative to the central vertical axis of the drum cluster while the clamping device was considerably right or left of center relative to the frame, poor load balance could result.

The drum handling apparatus of the present invention eliminates the problems described above and affords other features and advantages heretofore not obtainable.

SUMMARY OF THE INVENTION

A multiple drum handling apparatus incorporating the unique features of the invention provides improved performance in several respects, particularly as to improved accuracy in locating a latching device relative to the central vertical axis of a four-drum cluster. This improved accuracy provides good load balance and faster loading of drums on export containers, trucks, vans, and the like. Also, the invention minimizes the risk of damage to the drum itself (such as denting), damage to drum labels (such as tearing and scuffing), and the like during the handling process. The apparatus allows simultaneous stacking of four drums. When used with reverse fork lifts, the apparatus allows double stacking of the four-drum clusters within a standard export container, i.e. "TEU" or twenty-foot equivalent unit container. The apparatus is particularly suitable for use with currently used metal drums such as those made of steel, molded plastic drums, and the like.

The apparatus is designed for use in association with a forklift truck or the like and is particularly adapted for handling a four-drum cluster where the drums are arranged symmetrically about a central vertical axis. In this condition the drums define a four-pointed-star-shaped central space.

The apparatus includes a frame with a pair of parallel shoes (horizontal tubular members) into which the forks of the truck are inserted. The frame also supports a horizontal mounting plate adapted to be positioned over the central space, the plate defining a central opening.

A suspension plate is slidably supported on portions of the top surface of the mounting plate that surround the central opening. The sliding movement of the suspension plate is confined to lineal motion in forward or rearward directions by means of parallel guides located on the mounting plate on opposite sides of the central opening. The suspension plate has opposite side edges parallel to its linear path of travel and adapted to engage the guides so as to confine the movement of the suspension plate to lineal motion as described.

A latching device is connected, through the central opening, to the suspension plate and is adapted to be located over the central space. The latching device is free to move horizontally with the suspension plate as the suspension plate moves in its linear path of travel, however, the latching device may be urged to its centered position by centering springs. The device is adapted to be lowered into the central space and has pairs of jaws operated in response to vertical movement of the device such as to engage and clamp onto rim portions of the metal or plastic drums.

The frame is also provided with a pair of spaced vertical legs located at the rearward end thereof, each of which has a back rest secured thereto and adapted to engage the two drums located on and defining one side of the four-drum cluster. The back rests aid the operator of the forklift truck in properly locating the frame (and the latching device) relative to the central vertical axis of the cluster and supports the cluster during the handling process allowing for faster loading and for the prevention of damage to the drums or labels thereon.

The back rests are preferably provided with padding to minimize damage to the drums themselves or to any labels that may be on the cylindrical panels defined by the annular drum rings.

DESCRIPTION OF THE PREFERRED EMBODIMENT

Figure 1:
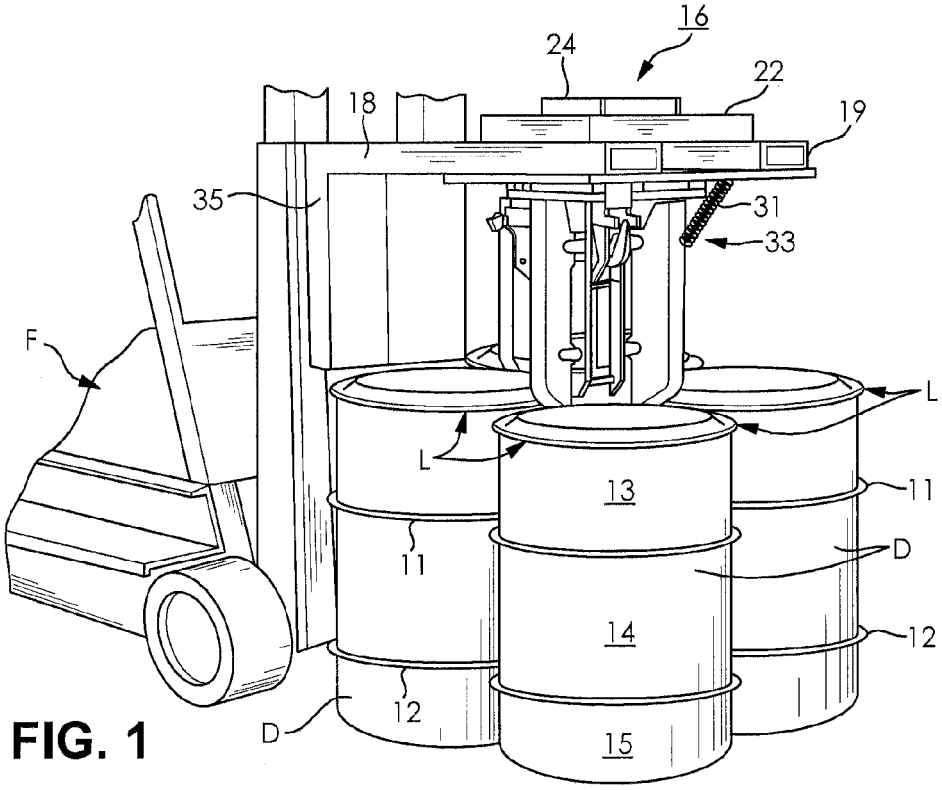
FIG. 1 is a fragmentary perspective view showing an apparatus embodying the invention and carried as an attachment to a forklift truck, the apparatus being positioned by the forklift truck to engage four drums arranged symmetrically in a four drum cluster preparatory to latching onto and lifting the drums for transport.

Referring more particularly to the drawings and initially to FIGS. 1 and 2, the invention is described in connection with the handling of four drums D formed of metal or molded plastic material, each drum having an "L" shaped or other suitably shaped peripheral chime ring at its upper end that is adapted to be latched by the apparatus. Also, each drum D has a lid L and is divided by a pair of drum rings 11 and 12, into three cylindrical panels 13, 14 and 15. As shown in FIG. 1, the drums D are arranged symmetrically in a four-drum cluster about a central vertical axis and the cluster defines a central four-pointed-star-shaped central space.

A forklift truck F carries as an attachment, a drum handling apparatus 16 adapted to be connected to the four drums of the cluster. The handling apparatus 16 is adapted to be raised and lowered between the initial position shown in FIG. 1 where the drums rest on the floor, and a raised position as shown in FIG. 2, wherein the drum cluster is lifted off the floor. FIG. 2 shows the drums raised to an intermediate position, but the forklift truck may lift the handling apparatus 16 sufficiently to stack the drums on another cluster if desired.

Figure 2:
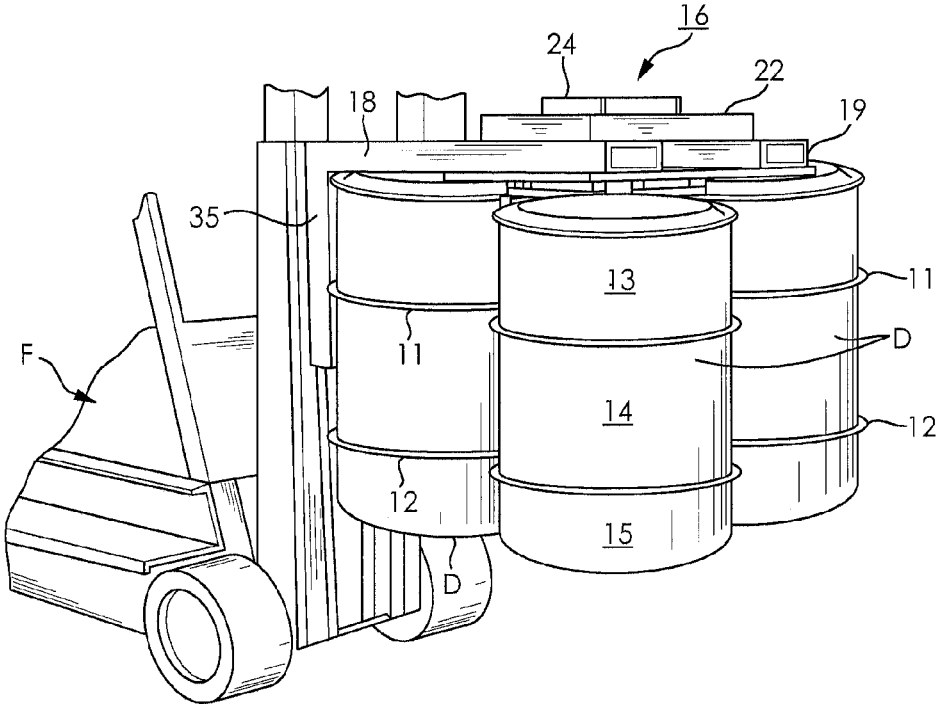
FIG. 2 is a fragmentary perspective view similar to FIG. 1 showing the four-drum cluster being lifted to a raised position for transport.

When the drums D are lifted, the lower ends thereof tilt slightly inward as shown in FIG. 2. This minimal tipping, however, is insufficient to present any problem in stacking.

The drum handling apparatus 16 has a frame 17 that includes a pair of parallel horizontal tubular members 18 and 19 that serve as "shoes" to receive the forks, 20 and 21, of the forklift truck F. The frame 17 also includes a generally rectangular, horizontal mounting plate 22 that is that is attached to the tops of the outer portions of the tubular members 18 and 19 so as to be operatively positioned during the handling process, over the central space. The mounting plate 22 also defines a central opening 23 adapted to be located over the central space and approximately centered at the vertical axis of the four-drum cluster.

Figure 3:
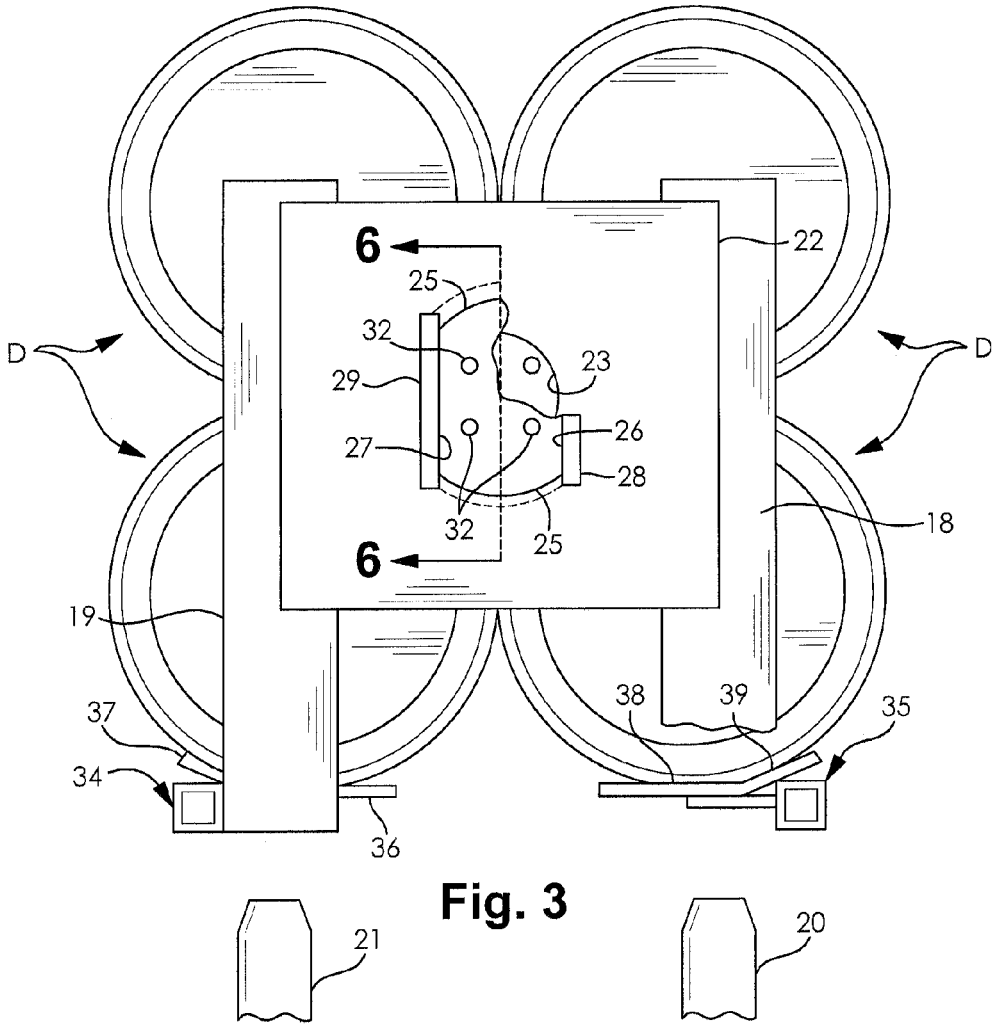
FIG. 3 is a plan view of the apparatus of the invention positioned over four drums arranged symmetrically in a four-drum cluster with parts broken away and shown in section for the purpose of illustration.

A suspension plate 24 is slidably supported on central portions of the top surface of the mounting plate that surround the central opening 23 as best shown in FIG. 3. The suspension plate 24 has a pair of opposed arcuate end edges 25 and a pair of opposed straight parallel side edges 26 and 27. Sliding movement of the suspension plate 24 on the mounting plate 22 is confined to lineal motion in a forward or rearward path of travel by a pair of parallel horizontal guide rails 28 and 29 attached to the mounting plate adjacent the central opening 23. The rails 28 and 29 engage the side edges 26 and 27 of the suspension plate 24 as best shown in FIG. 3.

The suspension plate 24 is connected to a cap plate 30 by four bolts 32, the cap plate being located for the most part within the central opening 23. The cap plate 30 is adapted to engage the end edges of the central opening 23 to limit the sliding movement of the suspension plate 24 in its forward or rearward lineal path of travel, as illustrated by the arcuate dotted lines in FIG. 3.

Figure 5:
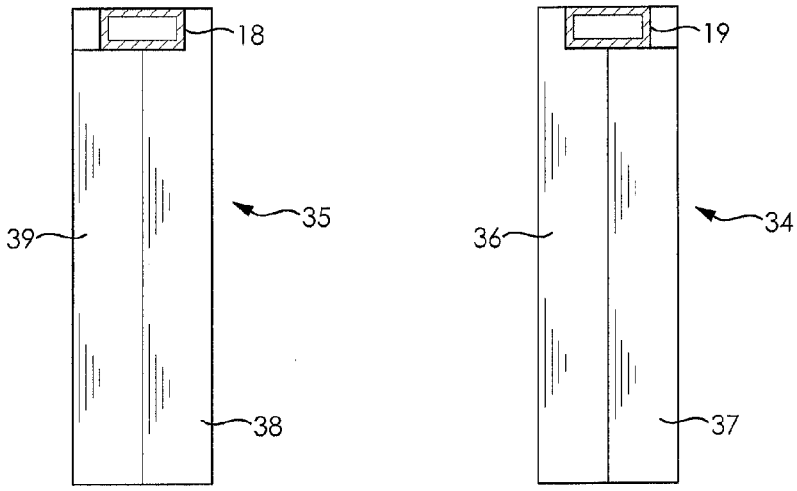
FIG. 5 is a sectional view taken on the line 5-5 of FIG. 4 but with the drums removed.
Figure 6:
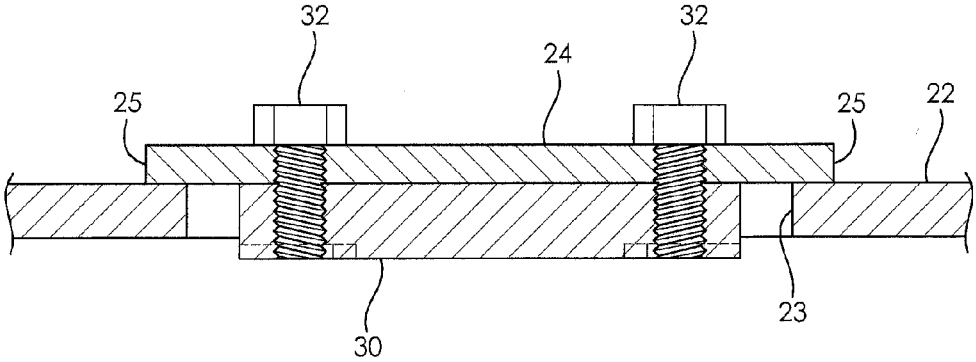
FIG. 6 is a fragmentary sectional view on an enlarged scale taken on the line 6-6 of FIG. 4

A latching device 33 is located below and attached to the suspension plate 24 through the cap plate 30, as best shown in FIGS. 5 and 6. The device may be urged to its centered position relative to the lineal path of travel of the suspension plate 24 by centering springs 31 if desired. The latching device 33 is adapted to be lowered into the central space of the drum cluster by the handling apparatus 16 and has four pairs of jaws operable to engage and clamp onto rim portions of a respective drums D. The latching device may be of the type shown and described in U.S. Pat. Nos. 3,338,616, 3,718,228 and/or 4,911,605. In the case of the latching device 33, of the invention, however, the vertical dimension of the device is limited to assure that any contact between the device 33 and the drums D is no lower than the upper cylindrical panel 13. This is to minimize the risk of damage to the cylindrical panels or any labels that may be on the panels.

Figure 4:
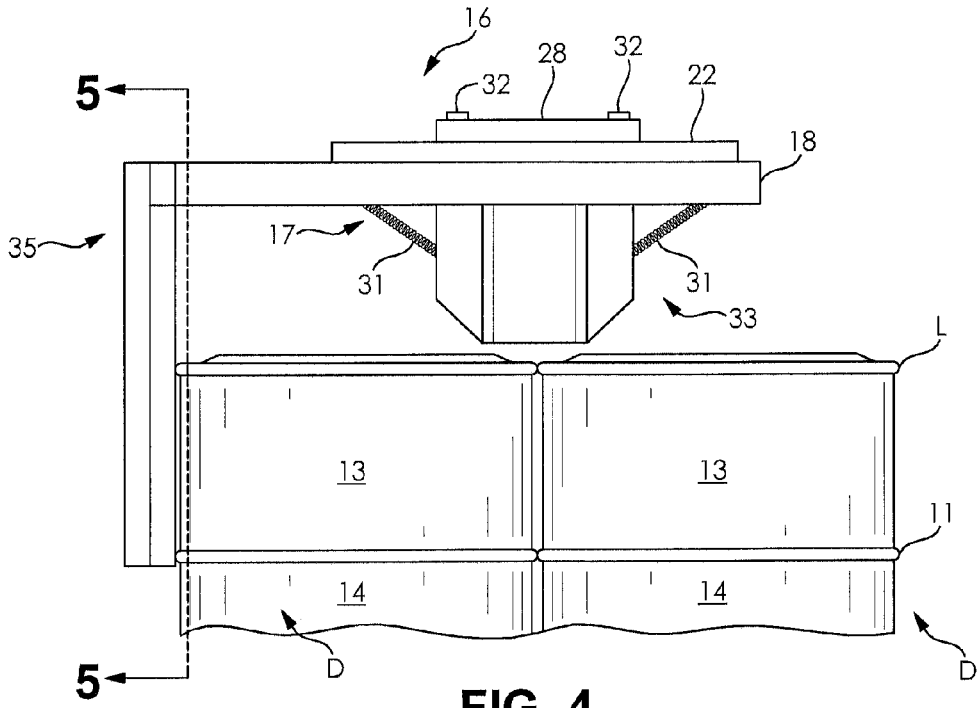
FIG. 4 is a fragmentary side elevation showing the apparatus of the invention along with two drums of a four-drum cluster to be handled by the apparatus.

The frame 17 is also provided with a pair of spaced vertical legs 34 and 35 located at the rearward end thereof as best shown in FIGS. 3, 4 and 5. Each leg 34, 35 has a back rest attached thereto, each back rest being so positioned as to engage one of the two drums D located on one side of the drum cluster. The back rests each have two vertical panels including a main panel 36, 38 that faces forward and an adjacent end panel 37, 39 that is tilted inward as shown in FIG. 3. The panels 36, 37, 38 and 39 are preferably padded to minimize damage to the cylindrical panels 13, 14 and 15 of the drums D and the panels 36, 37, 38 and 39 as well as the legs 34 and 35, are of sufficient length that the back rest panels engage the drums D as low as the middle cylindrical panel 14 of the drums to provide adequate support to the drums during handling of the drum cluster and allowing for faster loading of the drums and the prevention of damage to the drums or labels thereon.

In the operation of the drum handling apparatus 16 of the invention, the operator of the forklift truck F, with the forks 20 and 21 of the truck inserted into the horizontal tubular members 18 and 19, brings the apparatus into an initial position (FIG. 1) with the latching device 33 approximately centered over the central space of the drum cluster. In this position the back rests panels 36, 37 38 and 39 engage two of the drums that form one side of the cluster. This aids the operator in locating the latching device 33 in approximate vertical alignment with the central axis of the cluster along the forward/rearward centerline of the frame.

The operator also brings the latching device 33 to a laterally centered position relative to the central vertical axis of the drum cluster. This is easier for the operator to do because he has a better visual reference as to the left/right position of the device in relation to the central vertical axis of the cluster than he has to the forward/rearward position of the device in relation to the central vertical axis of the cluster. For this reason, any sliding movement of the suspension plate 24 in a lateral direction is unnecessary and in fact undesirable. The apparatus of the invention prevents any such lateral sliding movement through use of the guide rails 28 and 29.

The operator then lowers the latching device 33 into the central space and as the device is lowered it may engage portions of one or more drums so as to cause forward or rearward sliding movement of the suspension plate 24. The forward/rearward sliding movement will bring the latching device into more accurate vertical alignment with the vertical centerline of the drum cluster.

When the latching device 33 is lowered to the correct position, the clamping jaws latch onto peripheral rim portions of a respective drum. Then the operator lifts the cluster to a raised position as shown in FIG. 2 (or higher as needed) and the drums may be moved to a new location where they may be stacked as appropriate. The lifting and lowering movement of the clamping device is effective to automatically operate the clamping jaws.

While the invention has been shown and described with respect to a specific embodiment thereof, this is intended for the purpose of illustration rather than limitation and other variations and modifications of the specific embodiment herein shown and described will be apparent to those skilled in the art, all within the intended spirit and scope of the invention. Accordingly, the patent is not to be limited in scope and effect to the specific embodiment shown and described, or in any other way that is inconsistent with the extent to which the progress in the art has been advanced by the invention.

The invention claimed is:

1. Apparatus for use in combination with a forklift truck or the like for simultaneously handling multiple drums arranged symmetrically in a cluster about a central vertical axis, side wall portions of said drums defining a central space, comprising:

a frame adapted to be carried by said forklift truck or the like, a horizontal mounting plate supported by said frame and defining a central opening, suspension means slidably supported on portions of a top surface of said mounting plate that surround said central opening, guide means on said mounting plate to confine sliding movement of said suspension means to forward or rearward movement along a lineal path of travel, and latching means located below and attached to said suspension means, said latching means adapted to be lowered into said central space whereby portions of said latching means may engage portions of said drums to urge said suspension means in a forward or rearward direction along said lineal path of travel to more accurately locate said latching means in vertical alignment with said central vertical axis of said drum cluster.

2. Apparatus as defined in claim 1 wherein said cluster comprises four drums.

3. Apparatus as defined in claim 1 wherein said suspension means comprises a suspension plate with opposite side edges that are parallel to the direction of linear movement of said suspension plate.

4. Apparatus as defined in claim 3 wherein said opposite side edges of said suspension plate engage said guide means on said mounting plate whereby said guide means confines sliding movement of said suspension plate to said lineal path of travel.

5. Apparatus as defined in claim 4 wherein said guide means comprises two parallel rails located on opposite sides of said central opening and adapted to be operatively engaged by said side edges of said suspension plate.

6. Apparatus as defined in claim 1 wherein said drums are formed of metal or molded plastic material.

7. Apparatus as defined in claim 6 wherein said drums have "L" shaped peripheral chime rings.

8. Apparatus as defined in claim 1 wherein said apparatus has a pair of parallel vertical legs located at the rearward end of said frame and extending downwardly from the top of said frame to at least the middle of the drums.

9. Apparatus as defined in claim 8 wherein said legs each define a backrest positioned to engage the sidewall of a respective drum.

10. Apparatus as defined in claim 9 wherein said backrests are padded.

11. Apparatus for use in combination with a forklift truck for handling four drums arranged symmetrically in a cluster about a central vertical axis, side wall portions of said drums defining a central space, comprising:

a frame adapted to be carried by said forklift truck, a horizontal mounting plate supported by said frame and defining a central opening, a suspension plate slidably supported on portions of a top surface of said mounting plate that surround said central opening, guide rails on said mounting plate to confine sliding movement of said suspension plate to forward or rearward movement along a lineal path of travel, and a latching device located below and attached to said suspension plate, said latching device adapted to be lowered into said central space whereby portions of said latching device may engage portions of said drums to urge said suspension plate in a forward or rearward direction along said lineal path of travel to more accurately locate said latching device in vertical alignment with said central vertical axis of said four-drum cluster.

12. Apparatus as defined in claim 11 wherein said suspension plate has opposite side edges that are parallel to the direction of linear travel of said suspension plate.

13. Apparatus as defined in claim 12 wherein said opposite side edges of said suspension plate engage said guide rails whereby said guide rails confine sliding movement of said suspension plate to said linear path of travel.

14. Apparatus as defined in claim 11 wherein said drums are formed of metal or molded plastic material.

15. Apparatus as defined in claim 14 wherein said drums have "L" shaped peripheral chime rings.

16. Apparatus as defined in claim 11 wherein said apparatus has a pair of parallel vertical legs located at the rearward end of said frame and extending downwardly from the top of said frame to at least the middle of the drums.

17. Apparatus as defined in claim 16 wherein said legs each have a backrest positioned to engage the sidewall of a respective drum.

18. Apparatus as defined in claim 17 wherein said backrests are padded.

* * * * *